US007881851B2

(12) United States Patent
Kernwein et al.

(10) Patent No.: US 7,881,851 B2
(45) Date of Patent: Feb. 1, 2011

(54) METHOD OF OPERATING GLOW PLUGS IN DIESEL ENGINES

(75) Inventors: Markus Kernwein, Bretten-Büchig (DE); Andreas Beil, Ludwigsburg (DE); Jörg Stöckle, Ludwigsburg (DE); Olaf Toedter, Wössingen (DE); Hans Houben, Würselen (DE)

(73) Assignee: BERU Aktiengesellschaft, Ludwigsburg (DE)

( * ) Notice: Subject to any disclaimer, the term of this patent is extended or adjusted under 35 U.S.C. 154(b) by 212 days.

(21) Appl. No.: 12/215,997

(22) Filed: Jun. 30, 2008

(65) Prior Publication Data

US 2009/0012695 A1 Jan. 8, 2009

(30) Foreign Application Priority Data

Jul. 6, 2007 (DE) ..... 10 2007 031 613

(51) Int. Cl.
*F02D 45/00* (2006.01)

(52) U.S. Cl. ..... 701/102; 123/145 A; 219/270

(58) Field of Classification Search ..... 701/101, 701/102, 113–115; 123/145 A, 145 R; 219/270
See application file for complete search history.

(56) References Cited

U.S. PATENT DOCUMENTS 4,478,181 A 10/1984 Kikuchi et al.
4,646,777 A 3/1987 Stalder et al.
4,939,347 A * 7/1990 Masaka et al. ..... 219/492
5,172,664 A 12/1992 Mueller et al.
5,329,901 A 7/1994 Onishi
5,372,102 A 12/1994 Schmid et al.
5,729,456 A * 3/1998 Boisvert et al. ..... 701/99
6,635,851 B2 10/2003 Uhl
6,712,032 B2 3/2004 Uhl et al.
6,843,218 B2 * 1/2005 Kumada et al. ..... 123/179.6
7,528,346 B2 5/2009 Serra et al.
2002/0033155 A1 * 3/2002 Jung ..... 123/145 A
2005/0039732 A1 2/2005 Toedter et al.
2006/0207541 A1 * 9/2006 Hiramatsu ..... 123/145 A (Continued)

FOREIGN PATENT DOCUMENTS

DE 37 29 638 A1 3/1989

(Continued)

OTHER PUBLICATIONS

MTZ Motortechnische Zeitschrift 61 (2000) 10.

*Primary Examiner*—Stephen K Cronin
*Assistant Examiner*—Johnny H Hoang
(74) *Attorney, Agent, or Firm*—Walter A. Hackler

(57) ABSTRACT

The invention describes a method for operating glow plugs in a diesel engine that comprises a housing and a heater element projecting beyond that housing which interacts with an engine control unit and a glow plug control unit which, following a preheating phase, controls the electric power supplied to the glow plugs in dependence on an input received from the engine control unit. According to the invention it is provided that the engine control unit determines a value representative of a temperature that is to be reached at the heater element and the engine control unit transmits that value as target value to the glow plug control unit which converts that target value using an algorithm stored in the glow plug control unit and taking into account the characteristic values stored in the glow plug control unit.

22 Claims, 1 Drawing Sheet

U.S. PATENT DOCUMENTS

2008/0163840 A1 7/2008 Toedter et al.

FOREIGN PATENT DOCUMENTS

DE 197 08 430 A1 11/1997
DE 10 2005 061 878 A1 6/2007
DE 10 2006 010 081 A1 6/2007
DE 10 2006 010 082 A1 6/2007
DE 10 2006 010 083 A1 6/2007

* cited by examiner

METHOD OF OPERATING GLOW PLUGS IN DIESEL ENGINES

The present invention relates to a method for operating glow plugs. A method of this kind has been known from the paper entitled "Instant Start System (ISS)—The electronically controlled glow system for diesel engines", published in DE-Z MTZ Motortechnische Zeitschrift 61, (2000) 10, pp. 668-675.

FIG. 1 shows a block diagram of a glow plug control unit 1 intended for carrying out the known method. This control unit comprises a microprocessor 2 with integrated digital-to-analog converter, a number of MOSFET power semiconductors 3 for switching on and off an identical number of glow plugs 4, an electric interface 5 for establishing connection with an engine control unit 6 and an internal voltage supply 7 for the microprocessor 2 and the interface 5. The internal power supply 7 is connected to the vehicle battery via "terminal 15" of the vehicle.

The microprocessor 2 controls the power semiconductors 3, reads their status information and communicates with the engine control unit 6 via the electric interface 5. The interface 5 effectuates an adaptation of the signals required for communication between the engine control unit 6 and the microprocessor 2. The voltage supply 7 supplies a steady voltage for the microprocessor 2 and the interface 5.

The task of the glow plugs is to ensure a safe ignition of the fuel-air mixture when the diesel engine is started in cold condition, and thereafter, in an after-glow phase, to procure a smooth running of the diesel engine until the engine is hot enough to guarantee a steady smooth running even without the support by glow plugs. The after-glow phase takes up to a few minutes. During the after-glow phase, the glow plug is to assume a constant temperature, the steady-state temperature, for which approximately 1000° Celsius is a typical value. For maintaining the steady-state temperature, modern glow plugs do not require the full voltage provided by the electric system of the vehicle, but rather a voltage of typically 5 volts to 6 volts. For this purpose, the power semiconductors 3 are controlled by the microprocessor 2 by means of a pulse-width modulation method with the result that the voltage provided by the vehicle's electric system, which is supplied to the power semiconductor 3 via "terminal 30" of the vehicle, is modulated so that the desired voltage is applied to the glow plugs in time average.

When the diesel engine is cold-started, then the control unit 1 supplies the glow plugs 4 with a higher heating-up voltage of, e.g., 11 volts so that the glow plugs will reach, as quickly as possible, a temperature equal to the steady-state temperature or—preferably—a temperature some 10° above that temperature. According to the teachings of MTZ 61 (2000) 10, pp. 668-675, the rapid heating-up of the glow plugs is energy-controlled in the pre-heating phase, which means that the respective glow plug is supplied with an energy suitably predetermined to ensure that the steady-state temperature will be reached in any case. Preferably, the steady-state temperature is initially exceeded and it then drops to the steady-state temperature.

Following a cold start, the engine will for some time operate in what is known as the cold-running phase, which is characterized by an idling speed that is higher than the idling speed of the engine at operating temperature. During the cold-running phase, the effective voltage applied to the glow plugs, i.e., the voltage applied in time average as a result of the pulse-width modulation, is lowered by steps from the initial heating-up voltage of, e.g., 11 volts (the "initial value") to a voltage of, for example, 6 volts (the "target value" of the voltage) at which the steady-state temperature of the glow plugs of, e.g., 1000° Celsius can be maintained. Any variations of the voltage of the electric system of the vehicle can be stabilized at the pulse-width modulation by varying the running time.

According to prior art, the voltage applied to the glow plugs 4 in time average is lowered by steps in the cold-running phase during a predefined period of time based on empirical values stored in the microprocessor 2. The period of time during which the effective voltage is increased in the cold-running phase is at the most as long as the cold-running phase as such but preferably shorter than it.

The glow plugs are cooled down to different degrees depending on the engine speed and the engine load or the engine torque. However, in order to still keep constant the glow plug temperature, with the engine at operating temperature, after the cold-running phase, but before the normal operating temperature of the engine is reached, the electric power applied to the glow plugs is adjusted to the varying conditions. This is done according to signals received from the engine control unit 6 by increasing or lowering the final value of the voltage applied in time average to the glow plugs 4.

According to prior art, it is the engine control unit that decides, on the basis of evaluations made by itself, when the glow plug operations are to be initiated and for how long they should continue. The engine control unit is provided for this purpose with an intelligence unit that is operated with the aid of a state machine integrated in the engine control unit. The state machine operates on the basis of a rigid, firmly predefined scheme and produces instruction signals that are transmitted to the glow plug control unit, usually provided on the engine block, which then implements the input received from the engine control unit for the purpose of controlling the electric power supplied to the glow plugs, with reference to the glow plug model stored in the glow plug control unit. This requires that the two control units and the algorithms performed by them, to the extent they are related to the control of the glow plugs, be adapted one to the other.

It is the object of the present invention to reduce the expense of realizing the control of glow plugs.

SUMMARY OF THE INVENTION

The invention achieves this object by a method having the features defined in claim 1. Advantageous further developments of the invention are the subject-matter of the subclaims.

BRIEF DESCRIPTION OF THE DRAWINGS

The present invention may be more readily understood by consideration of the following detailed description when taken in conjunction with the accompanying drawings, in which.

DETAILED DESCRIPTION

Figure 1:
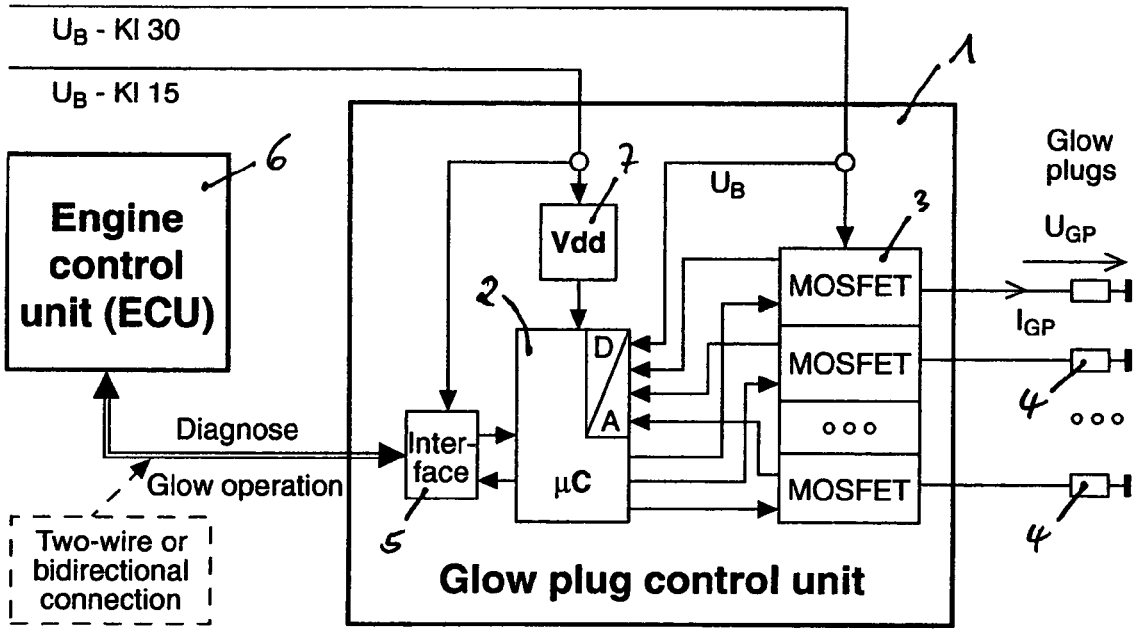
FIG. 1 shows a block diagram of a glow plug control unit intended for carrying out the known method.

The method according to the invention for the operating of glow plugs that project with a heater element into a diesel engine which interacts with an engine control unit and with a glow plug control unit that, after a preheating phase, controls the electric power supplied to the glow plugs in dependence on an input received from the engine control unit, is characterized in that the engine control unit determines a value defining a reference steady-state temperature to be reached at the heater element and that it transmits this value to the glow plug control unit. This unit converts this target value using an algorithm stored in the glow plug control unit and with consideration to characteristic values likewise stored in the glow plug control unit, whereby the target value effectuates a change of the steady-state temperature of the heater element from a first reference steady-state temperature to a second reference steady-state temperature.

In the method according to the invention, the temperature of the heater elements can be changed with the running engine in dependence on the operating state of the diesel engine. The temperature of a glow plug subsequent to a pre-heating phase, i.e., with running engine, is commonly called steady-state temperature since according to prior art it is held as constant as possible. Although according to a method according to the invention, subsequent to the input of the engine control unit, the temperature can be changed while the engine is running and therefore does not remain constant, the usual term steady-state temperature is kept. In contrast to prior art, the method according to the invention consists of not only one but several reference steady-state temperatures, according to which the glow plug control unit controls the temperature of the heater elements.

This provides considerable advantages:

The glow plug control unit receives a target value, i.e. the temperature that is to be reached at the heater element, or a value representative of that temperature. That temperature is the proper target value in view of the engine operation because the temperature of the heater element, especially its surface temperature, is the decisive factor which ensures that the fuel-air mixture can be satisfactorily ignited during the starting and the cold running phases of the diesel engine, and which further may have a decisive influence on emission and engine running characteristics at additional operating points of the engine.

The minimum requirements regarding the temperature of the heater element of the glow plugs to ensure the ignition of the fuel-air mixture depend on the type of engine, its operating state and on the manner in which the vehicle is driven, whereas the dependence on the type of glow plug used can be neglected. Thus, it is best for the engine control unit to determine a value defining the temperature to be reached at the heater element of the glow plugs. This value can coincide with the reference temperature or systematically slightly deviate from it.

The behavior of glow plugs in diesel engines depends on the type of glow plug used. Thus, it is best to take into consideration exclusively at the glow plug control unit the characteristics and boundary conditions under which the heater element of glow plugs assumes a temperature defined as target value because in this case the glow plug control unit will need only a single target value, namely the temperature to be reached at the heater element, or a value representative of that temperature.

The glow plug control unit can function independently based on the target value. Conversely, the engine control unit can operate without particular regard to the concrete operation of the glow plug control unit, as long as the latter supplies a target value for the temperature that can be processed by the glow plug control unit.

Consequently, the structure and function of the engine control unit on the one hand, and the glow plug control unit on the other hand, can be realized substantially independently one from the other. Mutual limitations with respect to the function of the two control units are minimized, which means that a maximum of degree of freedom is left for the configuration of the two control units and their respective operation. Especially, the developer of the engine control unit is no longer restricted by a state machine operating on the basis of a rigid scheme adapted to the glow plug control unit.

The manufacturer of the glow plugs, being predestined to produce the control unit for the glow plugs provided by him and to define its function, can do that without particular regard to the engine control unit.

Since the temperature to be reached by the heater element of the glow plugs is defined by the engine control unit, there is no dependence between the control of the glow plugs and any state of the engine control or any transition in state of the engine control. The glow plug control unit can react autonomously to any input of the engine control unit.

According to prior art, after a pre-heating phase, the glow plugs are controlled in such a manner that the temperature reached at the heater element remains, if possible, at the predetermined value, wherefore this temperature is designated as the steady-state temperature. According to a further advantageous development of the invention, the target value supplied by the engine control unit as value for the temperature to be reached at the heater element is, however, variable while the diesel engine is running, so that the steady-state temperature can be adapted to the operating state of the diesel engine. This presents a series of further advantages:

The temperature of the glow plugs can be optimized by adapting it to the operating state of the diesel engine.

The glow plug can be used not only during the starting phase and during a few minutes thereafter, but it may be used to support combustion even over a longer period of time.

The use of glow plugs as combustion support allows a reduction of the pollutant emissions of diesel engines.

Extending the operating time of glow plugs presents a special advantage with respect to the efforts on the part of the manufacturers of diesel engines to reduce the compression of the diesel engine in order to reduce the emission of nitrogen oxides. However, with a reduced compression, the cold-running behavior of the diesel engine deteriorates while the ignition temperature of the fuel-air mixture increases. These disadvantages can be remedied by the further development of the invention.

With an increasing heating-up of the engine, the temperature at the heater element of the glow plugs can be reduced. This leads to a longer service life of the glow plugs.

During the thrust phase of the diesel engine, the glow plugs can be operated with greatly reduced heating power for the combustion support, which contributes to a longer service life of the glow plugs.

With rising engine load, especially under full load, the temperature of the heater element of the glow plugs may be temporarily increased for enhancing the combustion and for reducing the pollutant emissions as well as for improving the quietness of the engine while the engine is not yet ready for operation.

Vehicles equipped with a particle filter in the exhaust-gas line of the diesel engine require a reconditioning of such filters from time to time, for example by temporarily increasing the exhaust-gas temperature so as to burn any particles adhering to the filter. By way of example, the temperature increase can be achieved by a subsequent injecting of diesel fuel into the cylinders during the expansion phase. If, during this phase, the heater element is operated at low temperature it will further the temperature increase at the particle filter. To be especially underlined is the possibility to lower the temperature of the glow plugs when the relatively high steady-state temperature of steel glow plugs of for example 1000° C., as set in prior art, is not needed. The therefrom resulting lower load on the glow plug can be used either to drastically extend the service life of the glow plug or to use it as combustion support over extended periods without any loss of service life.

The engine control unit determines advantageously the target value for the temperature at the heater element of the glow plug as a function of the operating state of the diesel engine. In determining the target value for the temperature, it is possible to consider not only the current operating state of the diesel engine but also the prior development of the operating state of the diesel engine that the engine control unit can observe by using associated sensors. This provides the possibility to react more quickly to variations in the operating state of the diesel engine which, based on the observed prior development, may even be predicted for a certain period of time.

The first and second reference steady-state temperatures differ preferably at most by 300 K, especially preferably not more than 200 K. The optimal temperatures for the different operating states of a diesel engine are typically within the range of 1000° C. to 1300° C., so that the first reference steady-state temperature is preferably at least 1000° C. Thus, adaptations of the reference steady-state temperature to modified situations require only very rarely larger temperature jumps than 300 K; in the majority of the cases, the difference between the first and the second steady-state temperatures is not higher than 200 K, especially not higher than 150 K.

Depending on whether the second reference steady-state temperature is higher or lower than the first reference steady-state temperature, the heating element is either heated-up or cooled off for the change of the steady-state temperature. Preferably, the algorithm used by the glow plug control unit at a heating-up of the steady-state temperature effectuates an overswinging of the temperature of the heating element with respect to the second reference steady-state temperature. This has the advantage of an especially rapid adaptation of the heating-up temperature to a modified operating state of the engine. Conversely, the algorithm used by the glow plug control unit for the cooling off effectuates an underswinging of the temperature of the heating element with respect to the second reference steady-state temperature.

The efficiency of a glow plug depends primarily on the surface temperature of the heater element of the glow plugs. Therefore, the surface temperature is the primary factor in determining the target value to be determined by the engine control unit.

Especially in the case of ceramic glow plugs, the surface temperature of the heater element of the glow plugs can be measured from the temperature-dependent value of the electric resistance.

However, based on empirical values obtained from an engine test-bench, it is possible to generate a model of the behavior of a given type of glow plugs in a given diesel engine and to then store that model in the glow plug control unit in the form of characteristic lines and/or characteristics fields and to control the glow plugs according to the characteristics lines or fields stored in such a manner so that, at given times, they will be supplied with a given effective voltage with which is reached or sufficiently approached the target temperature. For the selecting of the effective voltage and the duration during which the glow plugs will be supplied with the selected effective voltage, the glow plug control unit will take into account the characteristics and boundary conditions stored in the glow plug control unit. The characteristics and boundary conditions that may be stored in the glow plug control unit, and of which one or more can be taken into account, include the type of engine, the type of glow plug, the electric resistance of the glow plugs at a reference temperature, the dependence of the electric resistance of the glow plugs on the temperature, the thermal capacity of the glow plugs, the cooling-down behavior of the glow plugs as a function of engine speed, the coolant temperature and the algebraic sign or indication of a speed change of the engine, as well as the heat supply from combustion under one or more selected load conditions of the engine. Also, any limit and threshold values that restrict the glow plug control unit in implementing the target value supplied by the engine control unit can also be advantageously taken into account; for example, it can be ensured that a target value for the temperature of the heater element, transmitted by the engine control unit, that would overload the glow plugs used, will be limited to a value that is still acceptable to the glow plugs employed. According to an advantageous further development of the invention, the target value for the temperature of the heater element, supplied by the engine control unit, can therefore be interpreted by the glow plug control unit and adapted to the type of glow plug used, after the latter has been determined by the glow plug control unit itself, or has been entered into the glow plug control unit. The adaptation may consist in increasing or reducing the temperature target value and in varying the temperature curve leading to that target value, which might be determined on the basis of a model characteristic line of a glow plug, stored in the glow plug control unit, by correspondingly varying the model characteristics. The glow plug control unit then determines the energy that is to be supplied to the glow plugs which are then controlled correspondingly. Likewise, the coolant temperature may be used for deriving a limit value, e.g., by not taking into account the target value provided by the engine control unit for an increased glow plug temperature in order to spare the glow plugs, if and so long as the coolant temperature exceeds a given limit value.

Supplementing the target value for the temperature of the heater element of the glow plugs, the glow plug control unit may, in implementing the target value, advantageously consider additional parameters supplied to it from the outside, preferably from the engine control unit, such as, e.g., the rate of fuel injection per cycle, the coolant temperature, the speed of the diesel engine, the indication of any variation in speed of the diesel engine and the temperature of the combustion air flowing into the cylinders of the diesel engine.

Further, the glow plug control unit may take into account the maximum possible temperature, e.g., when steel glow plugs are used. Based on the type of glow plug determined or entered by the glow plug control unit, it may limit or interpret the predefined temperature.

Preferably, the target value of the temperature of the heater element is determined by the engine control unit in such a manner that at first a basic temperature is defined for the after-glow phase and that then a lower temperature than the basic temperature is preset as a target in one or more of the following cases: the diesel engine is in the thrust phase (in which case, the fuel supply may be switched off); the coolant temperature exceeds a given threshold value (the higher the coolant temperature, the sooner one can do without combustion support by a hot glow plug); the temperature of the combustion air flowing into the cylinders exceeds a given threshold value (any increase of the temperature of the combustion air increases the ignitability of the mixture and allows that the glow plug temperature be reduced); the voltage of the electric power source (voltage of the vehicle's electric system) is below a given threshold value (power consumption from the vehicle's electric system is limited as a precautionary measure in case it should be low).

A temperature higher than the hitherto preset temperature by the engine control unit can be specified by the engine control unit, e.g., in cases where one or more of the following conditions are fulfilled: the pollutants content in the exhaust gas of the diesel engine exceeds one or more limit values (in this case, increasing the temperature of the glow plugs may enhance combustion); a thrust phase of the diesel engine is terminated (the glow plug, having cooled down during the thrust phase, is heated up again for the next following load event); the coolant temperature is below a threshold value as it occurs in longer stop-and-go phases (increasing the temperature of the glow plugs enhances the combustion and reduces the pollutant emission, a point of particular importance in city traffic); the temperature of the combustion air flowing into the cylinder is below a threshold value (increasing the temperature of the glow plugs enhances the combustion and reduces the pollutant emission); the fuel injection rate or the load of the diesel engine rises and/or exceeds a threshold value (the increased temperature of the glow plug may have, at least temporarily, a combustion-enhancing effect; during heating-up, as regeneration enhancement for a particle filter present in the exhaust line of the diesel engine.

By way of example, a matrix of correction values may be stored in the glow plug control unit for correcting the supply of electric energy to the glow plug specified for standard cases in response to the speed and the momentary fuel consumption (e.g., in $mm^3$ per stroke). The matrix contains the correction values for distinct pairs of values for speed and consumption. The energy supply to the glow plugs tends to rise as the speed rises and to drop as consumption rises.

The model of the glow plugs and of their behavior in the diesel engine stored in the glow plug control unit in the form of characteristic values and characteristics fields, makes it possible for the glow plug control unit to implement an open control loop, based on the target value specified by the engine control unit for the temperature of the heater element of the glow plugs.

What is claimed is:

1. A method for operation of glow plugs that project with a heater element into a diesel engine which interacts with an engine control unit and with a glow plug control unit which, following a preheating phase, controls the electric power supplied to the glow plugs in dependence on an input received from the engine control unit, the method comprising:

determining a value defining a first steady-state temperature that is to be reached at the heater element;

transmitting the determined value as a target value to the glow plug control unit;

converting the target value with an algorithm stored in the glow plug control unit taking into account characteristic values stored in the glow plug control unit; and using the target value to effectuate a change of the steady-state temperature of the heater element from a first reference steady-state temperature to a second reference steady-state temperature, the first and second reference steady state temperature being variable.

2. A method according to claim 1, wherein the first steady-state temperature is at least 1000° C.

3. A method according to claim 1, wherein the first steady-state temperature is lower than the second steady-state temperature.

4. A method according to claim 2, wherein the algorithm effectuates an overswinging of the temperature of the heater element over the second reference steady-state temperature.

5. A method according to claim 1, wherein the first reference steady-state temperature is higher than the second reference steady-state temperature.

6. A method according to claim 5, wherein the algorithm effectuates an underswinging of the temperature of the heater element below the second reference steady-state temperature.

7. A method according to claim 1, wherein the difference between the first and the second reference steady-state temperatures is 300 K at the most.

8. A method according to claim 1, wherein the difference between the first and the second reference steady-state temperatures is 20 K at the most.

9. A method according to claim 1, wherein the target value is variable with running engine.

10. A method according to claim 1, wherein the target value is determined in dependence on the operating state of the diesel engine.

11. A method according to claim 9, wherein the target value is determined in dependence on the previously effectuated evolution of the operating state of the diesel engine.

12. A method according to claim 1, wherein the engine control unit predicts the evolution of the engine state and determines the target value in dependence on the predicted evolution of the engine state.

13. A method according to claim 12, wherein the engine control unit predicts the evolution of the engine state based on the previous evolution of the engine state.

14. A method according to claim 1, wherein the target value is a measure for the surface temperature of the heater element.

15. A method according to claim 1, wherein the glow plug control unit decides whether or not the heater operation is effectuated clocked or continuously.

16. A method according to claim 1, wherein the characteristics stored in the glow plug control unit comprise one or more of the following: the type of engine; the type of glow plug; the electric resistance of the glow plugs at a reference temperature; the dependence of the electric resistance of the glow plugs on temperature; the thermal capacity of the glow plugs; the cooling-down behavior of the glow plugs as a function of engine speed, of coolant temperature and of the algebraic sign of a change in speed of the diesel engine; the heat supply from combustion under one or more selected load conditions of the engine; limit values and threshold values that restrict the glow plug control unit in converting the target value supplied by the engine control unit, especially the limit values and threshold values of the temperature of the heater element and of the coolant.

17. A method according to claim 1, wherein the glow plug control unit, for the conversion of the target values, takes into consideration parameters that are supplied to it and that comprise one or several of the following: the fuel injection rate; the coolant temperature; the speed of the diesel engine; the algebraic sign of a change in speed of the diesel engine; the temperature of the combustion air flowing into the cylinders of the diesel engine.

18. A method according to claim 17, wherein the engine control unit supplies the glow plug control unit with the parameters.

19. A method according to claim 1, wherein the value defining the temperature to be reached at the heater element is the only target value the glow plug control unit receives from the engine control unit.

20. A method according to claim 1, wherein the algorithm includes a decision tree.

21. A method according to claim 1, wherein in one or several of below itemized instances, the second steady-state temperature is set lower than the first steady-state temperature: the diesel engine is in the thrust phase; the coolant temperature exceeds a threshold value; the temperature of the combustion air flowing into the cylinders exceeds a threshold value; the temperature of the electric power source of the vehicle is below a limit value.

22. A method according to claim 1, wherein at least one of the below itemized instances, the second steady-state temperature is set higher than the first steady-state temperature: the pollutants content in the exhaust gas of the diesel engine exceeds one or more limit values; a thrust phase of the diesel engine is terminated; the coolant temperature is below a threshold value; the temperature of the combustion air flowing into the cylinders is below a threshold value; the fuel injection rate exceeds a threshold value; the load of the diesel engine rises and/or exceeds a threshold value; the temperature of a particle filter provided in the exhaust line of the diesel engine is raised for regeneration purposes.

* * * * *